US010609775B1

(12) United States Patent
Zhang et al.

(10) Patent No.: US 10,609,775 B1
(45) Date of Patent: Mar. 31, 2020

(54) THREE-LINE FOUR-WAY LIGHT STRING AND CONTROL SYSTEM THEREOF

(71) Applicants: Dongguan Yuanxiang Lamp Technology Co., Ltd., Dongguan, Guangdong Province (CN); Jiajun Wu, Dongguan, Guangdong Province (CN)

(72) Inventors: Yingchuan Zhang, Suzhou (CN); Jiajun Wu, Dongguan (CN); Jiajin Jiang, Dongguan (CN)

(73) Assignees: Dongguan Yuanxiang Lamp Technology Co., Ltd., Dongguan (CN); Jiajun Wu, Dongguan (CN)

( * ) Notice: Subject to any disclaimer, the term of this patent is extended or adjusted under 35 U.S.C. 154(b) by 0 days.

(21) Appl. No.: 16/454,795

(22) Filed: Jun. 27, 2019

(30) Foreign Application Priority Data

Oct. 29, 2018 (CN) ..... 2018 2 1763022 U

(51) Int. Cl.

| | |
|---|---|
| ***H05B 37/00*** | (2006.01) |
| ***H05B 39/00*** | (2006.01) |
| ***H05B 41/14*** | (2006.01) |
| ***H05B 33/08*** | (2020.01) |
| ***H05B 37/02*** | (2006.01) |

(52) U.S. Cl.
CPC ..... *H05B 33/0845* (2013.01); *H05B 33/0821* (2013.01); *H05B 37/0272* (2013.01)

(58) Field of Classification Search
USPC ..... 315/192
See application file for complete search history.

(56) References Cited

U.S. PATENT DOCUMENTS

| | | | | |
|---|---|---|---|---|
| 6,285,140 | B1 * | 9/2001 | Ruxton | H05B 33/0803 315/291 |
| 8,525,425 | B1 * | 9/2013 | Roudeski | H05B 33/089 315/185 R |
| 2004/0037079 | A1 * | 2/2004 | Luk | H05B 33/0857 362/249.06 |
| 2009/0154156 | A1 * | 6/2009 | Lo | F21V 5/00 362/234 |
| 2019/0234597 | A1 * | 8/2019 | Zhu | F21S 4/10 |

* cited by examiner

*Primary Examiner* — Anh Q Tran
(74) *Attorney, Agent, or Firm* — Bay State IP, LLC

(57) ABSTRACT

The present disclosure relates to decorative lamps, and in particular to a three-line four-way light string and control system thereof. The three-line four-way light string and control system thereof comprises signal lines L1, L0, L2, a plurality of LED lamps are connected between the signal line L1 and the signal line L0 in parallel, and a plurality of LED lamps are connected between the signal line L2 and the signal line L0 in parallel. The three-line four-way light string and control system thereof provided by the present disclosure can be produced by utilizing a full mechanization manner so as to have high yield and accuracy, save raw material and energy consumption, have a little pollution and be applicable to mass production.

9 Claims, 3 Drawing Sheets

THREE-LINE FOUR-WAY LIGHT STRING AND CONTROL SYSTEM THEREOF

CROSS REFERENCE TO RELATED APPLICATION

This application takes priority from and claims the benefit of Chinese Patent Application No. 201821763022.3 filed on Oct. 29, 2018, the contents of which are herein incorporated by reference.

TECHNICAL FIELD

The present disclosure relates to decorative lamps, and in particular to a three-line four-way light string and control system thereof.

BACKGROUND OF THE INVENTION

LED is very applicable to decoration due to its rich colors, small size, durability and energy saving property, and it can be used as a light source of a letter light, a sign board, a track light, a lamp tube and the like when being mounted on a circuit board, a flexible cable or other materials.

Currently, the common LED lamp achieves part of effects of a lattice screen, has a complicated circuit, and still utilizes the traditional manual wiring manner so as to have low efficiency and yield and high material consumption.

SUMMARY OF THE INVENTION

An objective of the present disclosure is to provide a three-line four-way light string and control system thereof, which can be produced in a mechanization manner and saves raw materials, in order to overcome the defects of the prior art.

To solve the technical problems, the present disclosure adopts the following technical scheme: the three-line four-way light string and control system thereof comprises signal lines L1, L0, L2, a plurality of LED lamps are connected between the signal line L1 and the signal line L0 in parallel, and a plurality of LED lamps are connected between the signal line L2 and the signal line L0 in parallel.

Furthermore, in order to greatly achieve the present disclosure, the following arrangement structure is specially utilized: a plurality of LED lamps are connected between the signal line L1 and the signal line L2 in parallel.

Furthermore, in order to greatly achieve the present disclosure, the following arrangement structure is specially utilized: the three-line four-way light string and control system thereof further comprises a signal line L0-1, and the signal line L0-1 is connected to the tail end of the signal line L0.

Furthermore, in order to greatly achieve the present disclosure, the following arrangement structure is specially utilized: the LED lamps are surface-mounted LED lamps.

Furthermore, in order to greatly achieve the present disclosure, the following arrangement structure is specially utilized: the three-line four-way light string and control system thereof further comprises a program controller, the program controller comprises an integrated chip U1, and a first pin, a third pin, a twelfth pin, a thirteenth pin and a fourteenth pin of the integrated chip U1 are floating;

a second pin of the integrated chip U1 is respectively connected to one end of a resistor R2 and a first pin of a relay J1, and the other end of the resistor R2 is respectively connected to one end of the capacitor C2, a fourth pin of the integrated chip U1, a third pin of the relay J1 and one end of a capacitor C1; the other end of the capacitor C2 is grounded; the fourth pin of the integrated chip U1 is connected to a power supply of 2.3-5.5 V; the other end of the capacitor C1 is connected to an eleventh pin of the integrated chip U1 and then is grounded; and a second pin of the relay J1 is grounded;

a fifth pin of the integrated chip U1 is connected to an input end Xin;

a sixth pin of the integrated chip U1 is connected to an output end Xout;

the input end Xin is respectively connected to one end of a capacitor C3 and one end of a crystal oscillator Y1; the other end of the capacitor C3 is grounded; and the other end of the crystal oscillator Y1 is connected to the output end Xout and then is grounded through the capacitor C4;

a seventh pin of the integrated chip U1 is grounded through a switch SW1;

an eighth pin of the integrated chip U1 is respectively connected to one end of a resistor R3, a grid electrode of a MOS transistor Q1 and a grid electrode of a MOS transistor Q2; the other end of the resistor R3 is grounded; a source electrode of the MOS transistor Q1 is grounded while a drain electrode thereof is connected to a drain electrode of the MOS transistor Q2 and then is connected to the signal line L2 together; and a source electrode of the MOS transistor Q2 is connected to the power supply of 2.3-5.5 V;

a ninth pin of the integrated chip U1 is respectively connected to one end of a resistor R4, a grid electrode of a MOS transistor Q3 and a grid electrode of a MOS transistor Q4; the other end of the resistor R4 is grounded; a source electrode of the MOS transistor Q3 is grounded while a drain electrode thereof is connected to a drain electrode of the MOS transistor Q4 and then is connected to the signal line L0 together; and a source electrode of the MOS transistor Q4 is connected to the power supply of 2.3-5.5 V; and a tenth pin of the integrated chip U1 is connected to one end of the resistor R2, and the other end of the resistor R2 is respectively connected to one end of a resistor R5, a grid electrode of a MOS transistor Q5 and a grid electrode of a MOS transistor Q6; the other end of the resistor R5 is grounded; a source electrode of the MOS transistor Q5 is grounded while a drain electrode thereof is connected to a drain electrode of the MOS transistor Q6 and then is connected to the signal line L1 together; and a source electrode of the MOS transistor Q6 is connected to the power supply of 2.3-5.5 V.

Furthermore, in order to greatly achieve the present disclosure, the following arrangement structure is specially utilized: the three-line four-way light string and control system thereof further comprises a remote control matching with a program controller, the remote control is internally provided with a chip and a storage battery, and the chip is provided with a wireless remote control device.

Furthermore, in order to greatly achieve the present disclosure, the following arrangement structure is specially utilized: the remote control is provided with a start key ON, a stop key OFF, a timing key TIMER, mode keys 1-8, a brightness reducing key – and a brightness increasing key +; and the start key ON, the stop key OFF, the timing key TIMER, the mode keys 1-8, the brightness reducing key – and the brightness increasing key + are connected to the chip.

Furthermore, in order to greatly achieve the present disclosure, the following arrangement structure is specially utilized: the three-line four-way light string and control system thereof further comprises a DC switched-mode power supply, and the DC switched-mode power supply is electrically connected to the program controller.

Furthermore, in order to greatly achieve the present disclosure, the following arrangement structure is specially utilized: the signal lines are copper lines.

Furthermore, in order to greatly achieve the present disclosure, the following arrangement structure is specially utilized: the LED lamps are arranged in a lampshade, and the lampshade has various colors.

The present disclosure has the following beneficial effects: the three-line four-way light string and control system thereof provided by the present disclosure can be produced by utilizing a full mechanization manner, so its yield is increased by 500 percent, mass production can be achieved, and no limitation to manpower shortage exists; mechanized production avoids defective products caused by errors of manual operation, and the accuracy is up to 99.99%; additionally, 70% of working process and 49% of raw material are saved; and more than 60% of energy consumption and 40% of carbon emission are reduced.

BRIEF DESCRIPTION OF THE DRAWINGS

To describe the technical schemes in the embodiments of the present disclosure or the prior art more clearly, the following briefly introduces the accompanying drawings required for describing the embodiments or the prior art. Apparently, the accompanying drawings in the following description show merely some embodiments in the present disclosure, and a person of ordinary skill in the art may still derive other drawings from these accompanying drawings without creative efforts.

DETAILED DESCRIPTION OF THE SEVERAL EMBODIMENTS

To make the objectives, technical schemes, and advantages of the present disclosure clearer, the following describes the technical schemes of the present disclosure in detail. Apparently, the described embodiments are merely a part rather than all of the embodiments of the present disclosure. All other embodiments obtained by a person of ordinary skill in the art based on the embodiments of the present disclosure without creative efforts shall fall within the protection scope of the present disclosure.

EMBODIMENT 1

Figure 1:
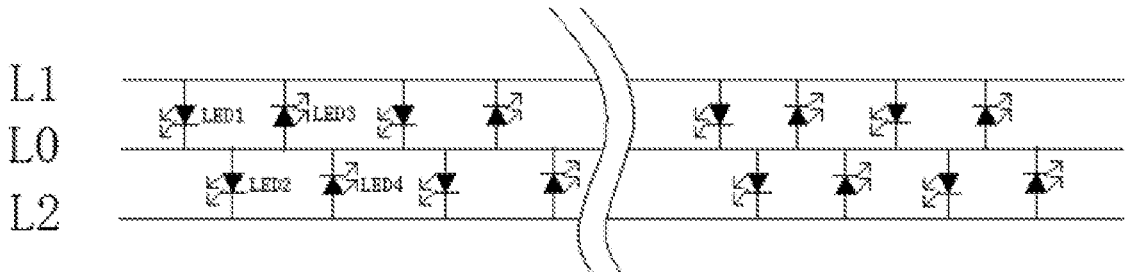
FIG. 1 is a schematic diagram of a circuit structure of a three-line four-way light string and control system thereof according to the present disclosure.
Figure 2:
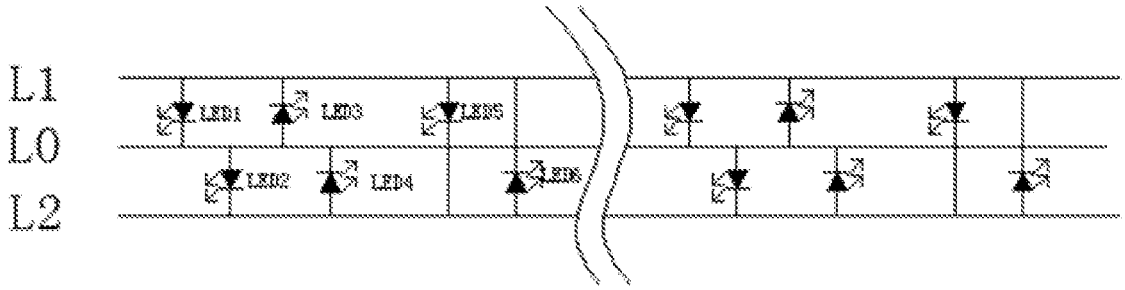
FIG. 2 is a schematic diagram of a derived circuit structure of a three-line four-way light string and control system thereof according to the present disclosure.
Figure 3:
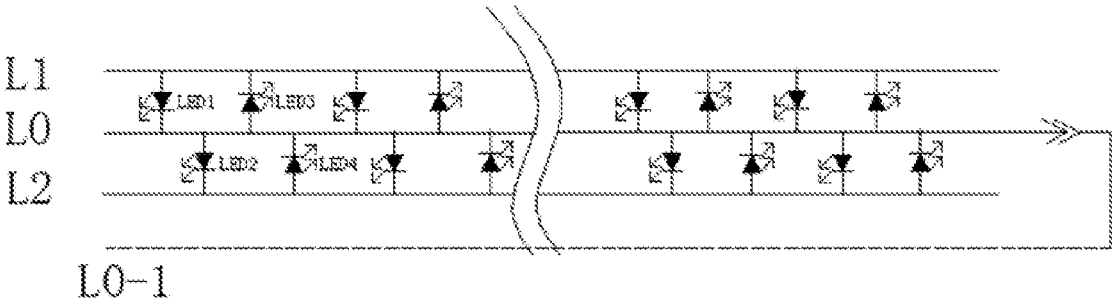
FIG. 3 is a schematic diagram of a derived circuit structure of a three-line four-way light string and control system thereof according to the present disclosure.
Figure 4:
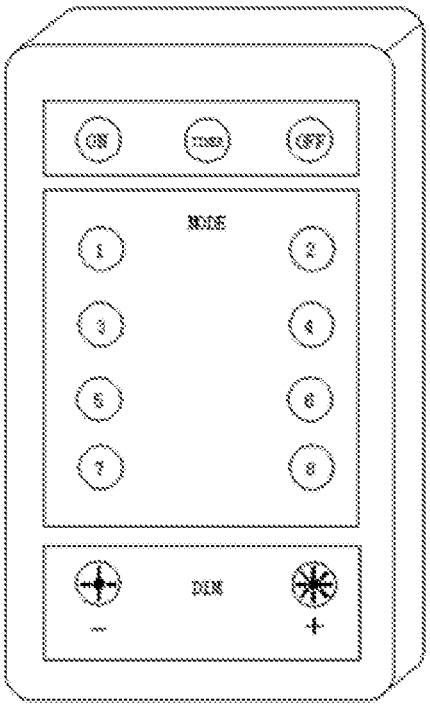
FIG. 4 is a schematic structural diagram of a remote control of a three-line four-way light string and control system thereof according to the present disclosure.
Figure 5:
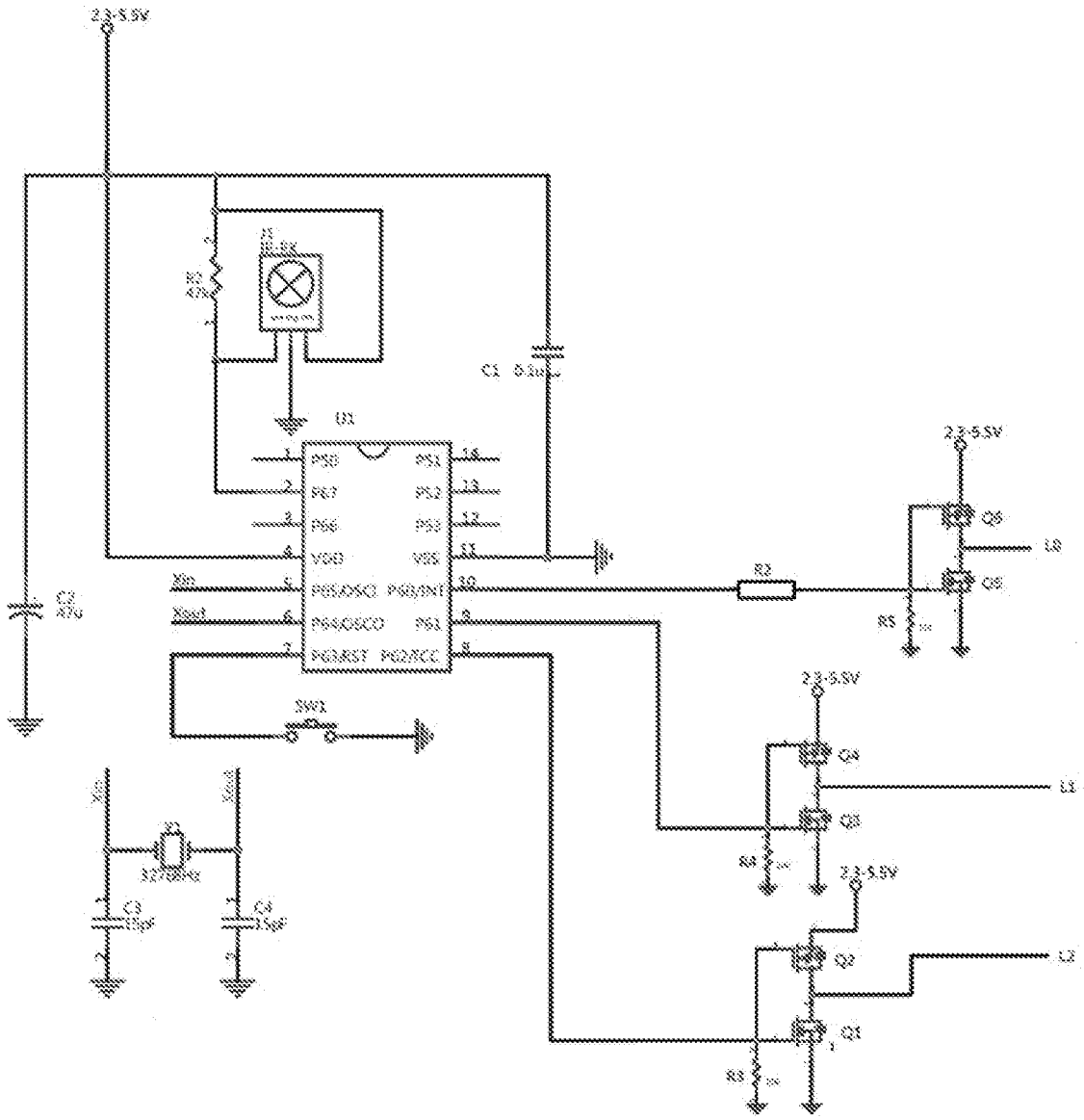
FIG. 5 is a schematic diagram of a circuit structure of a program controller of a three-line four-way light string and control system thereof according to the present disclosure.

As shown in FIG. 1 to FIG. 5, the three-line four-way light string and control system thereof of the present disclosure comprises signal lines L1, L0, L2, a plurality of LED lamps are connected between the signal line L and the signal line L0 in parallel, and a plurality of LED lamps are connected between the signal line L2 and the signal line L0 in parallel.

When the potential of the signal line L1 is high and the potential of the signal line L0 is low, a first LED lamp LED1 is turned on;

When the potential of the signal line L0 is high and the potential of the signal line L2 is low, a second LED lamp LED2 is turned on;

When the potential of the signal line L0 is high and the potential of the signal line L1 is low, a third LED lamp LED3 is turned on; and When the potential of the signal line L2 is high and the potential of the signal line L0 is low, a fourth LED lamp LED4 is turned on.

The traditional firework water-running light string utilizes a four-way five-line system, wherein total five lines including one neutral line and four IC lines are provided; and the traditional wiring manner is complex, wherein 20% of the traditional wiring operation needs labours to complete so as to waste time and materials. The three-line four-way light string and control system thereof provided by the present disclosure can be produced by utilizing a full mechanization manner, so its yield is increased by 500 percent, mass production can be achieved, and no limitation to manpower shortage exists; mechanized production avoids defective products caused by errors of manual operation, and the accuracy is up to 99.99%; additionally, 70% of working process and 49% of raw material are saved; and more than 60% of energy consumption and 40% of carbon emission are reduced.

Furthermore, based on the three-line four-way light string and control system thereof provided by the present disclosure, light strings of a three-line six-way system, a five-line eight-way system, a five-line four-way system, a six-line eight-way system, a six-line four-way system, a seven-line eight-way system, a seven-line four-way system and the like can be derived.

EMBODIMENT 2

Preferably, in order to greatly achieve the present disclosure and perform further optimization based on the above embodiment, the following arrangement structure is specially utilized: a plurality of LED lamps are connected between the signal line L1 and the signal line L2 in parallel.

When the potential of the signal line L1 is high and the potential of the signal line L2 is low, a fifth LED lamp LED5 is turned on; and When the potential of the signal line L2 is high and the potential of the signal line L1 is low, a sixth LED lamp LED6 is turned on.

Therefore, the present disclosure achieves a three-line six-way light effect, enriches the changing effect and is applicable to more scenes.

EMBODIMENT 3

Preferably, in order to greatly achieve the present disclosure and perform further optimization based on the above embodiments, the following arrangement structure is specially utilized: the three-line four-way light string and control system thereof further comprises a signal line L0-1, and the signal line L0-1 is connected to the tail end of the signal line L0. Arrangement of the signal line L0 solves a problem that the light string is overlong such that the tail generates voltage drop and then the LED lamp turns dark.

EMBODIMENT 4

Preferably, in order to greatly achieve the present disclosure and perform further optimization based on the above embodiments, the following arrangement structure is specially utilized: the LED lamps are surface-mounted LED lamps. The surface-mounted LED lamps greatly solve problems of brightness, visual angle, flatness, reliability, consistency and the like; and compared with other package devices, the surface-mounted LED lamps have the advantages of high anti-vibration capability, low solder joint defect rate, great high frequency characteristic and the like. Compared with the traditional insertion component, the surface-mounted LED lamps have the advantages of smaller size and weight.

EMBODIMENT 5

Preferably, in order to greatly achieve the present disclosure and perform further optimization based on the above embodiments, the following arrangement structure is specially utilized: the three-line four-way light string and control system thereof further comprises a program controller, the program controller comprises an integrated chip U1, and a first pin, a third pin, a twelfth pin, a thirteenth pin and a fourteenth pin of the integrated chip U1 are floating;

a second pin of the integrated chip U1 is respectively connected to one end of a resistor R2 and a first pin of a relay J1, and the other end of the resistor R2 is respectively connected to one end of the capacitor C2, a fourth pin of the integrated chip U1, a third pin of the relay J1 and one end of a capacitor C1; the other end of the capacitor C2 is grounded; the fourth pin of the integrated chip U1 is connected to a power supply of 2.3-5.5 V; the other end of the capacitor C1 is connected to an eleventh pin of the integrated chip U1 and then is grounded; and a second pin of the relay J1 is grounded;

a fifth pin of the integrated chip U1 is connected to an input end Xin;

a sixth pin of the integrated chip U1 is connected to an output end Xout;

the input end Xin is respectively connected to one end of a capacitor C3 and one end of a crystal oscillator Y1; the other end of the capacitor C3 is grounded; and the other end of the crystal oscillator Y1 is connected to the output end Xout and then is grounded through the capacitor C4;

a seventh pin of the integrated chip U1 is grounded through a switch SW1;

an eighth pin of the integrated chip U1 is respectively connected to one end of a resistor R3, a grid electrode of a MOS transistor Q1 and a grid electrode of a MOS transistor Q2; the other end of the resistor R3 is grounded; a source electrode of the MOS transistor Q1 is grounded while a drain electrode thereof is connected to a drain electrode of the MOS transistor Q2 and then is connected to the signal line L2 together; and a source electrode of the MOS transistor Q2 is connected to the power supply of 2.3-5.5 V;

a ninth pin of the integrated chip U1 is respectively connected to one end of a resistor R4, a grid electrode of a MOS transistor Q3 and a grid electrode of a MOS transistor Q4; the other end of the resistor R4 is grounded; a source electrode of the MOS transistor Q3 is grounded while a drain electrode thereof is connected to a drain electrode of the MOS transistor Q4 and then is connected to the signal line L0 together; and a source electrode of the MOS transistor Q4 is connected to the power supply of 2.3-5.5 V; and a tenth pin of the integrated chip U1 is connected to one end of the resistor R2, and the other end of the resistor R2 is respectively connected to one end of a resistor R5, a grid electrode of a MOS transistor Q5 and a grid electrode of a MOS transistor Q6; the other end of the resistor R5 is grounded; a source electrode of the MOS transistor Q5 is grounded while a drain electrode thereof is connected to a drain electrode of the MOS transistor Q6 and then is connected to the signal line L1 together; and a source electrode of the MOS transistor Q6 is connected to the power supply of 2.3-5.5 V.

The program controller can be expanded according to requirements, the integrated chip U1 can utilize various types, and the number of I/O ports are not limited.

EMBODIMENT 6

Preferably, in order to greatly achieve the present disclosure and perform further optimization based on the above embodiments, the following arrangement structure is specially utilized: the three-line four-way light string and control system thereof further comprises a remote control matching with the program controller, the remote control is internally provided with a chip and a storage battery, and the chip is provided with a wireless remote control device.

The arranged remote control can perform switching on/switching off, mode switching, brightness adjusting and timing operations within a certain distance so that the use is more convenient and quicker. The wireless remote control device can utilize infrared sensing or radar sensing.

EMBODIMENT 7

Preferably, in order to greatly achieve the present disclosure and perform further optimization based on the above embodiments, the following arrangement structure is specially utilized: the remote control is provided with a start key ON, a stop key OFF, a timing key TIMER, mode keys 1-8, a brightness reducing key – and a brightness increasing key +; and the start key ON, the stop key OFF, the timing key TIMER, the mode keys 1-8, the brightness reducing key – and the brightness increasing key + are connected to the chip. Due to all arranged keys, remote control can be achieved, and use is convenient; and the number of the keys on the remote control matches with the program controller.

EMBODIMENT 8

Preferably, in order to greatly achieve the present disclosure and perform further optimization based on the above embodiments, the following arrangement structure is specially utilized: the three-line four-way light string and control system thereof further comprises a DC switched-mode power supply, and the DC switched-mode power supply is electrically connected to the program controller. The switched-mode power supply is electrically connected to the program controller. One end of the DC switched-mode power supply is connected to a power supply of 220 V while the other end thereof is connected to the program controller so as to provide power for the light string; and the DC switched-mode power supply is further provided with a battery case matching with various types of dry batteries such as a lithium-ion storage battery, a nickel-chromium battery and the like.

EMBODIMENT 9

Preferably, in order to greatly achieve the present disclosure and perform further optimization based on the above embodiments, the following arrangement structure is specially utilized: the signal lines are copper lines.

EMBODIMENT 10

Preferably, in order to greatly achieve the present disclosure and perform further optimization based on the above embodiments, the following arrangement structure is specially utilized: the LED lamps are arranged in a lampshade, and the lampshade has various colors. The lampshade has various colors so as to be capable of achieving various light effects, such as a rainbow light, a meteor shower light, a firecracker light, a firework light, an explosion ball light, a centipede foot light and the like.

The above merely describes specific embodiments of the present disclosure, but the protection scope of the present disclosure is not limited thereto. A person skilled in the art can easily conceive modifications or replacements within the technical scope of the present disclosure, and these modifications or replacements shall fall within the protection scope of the present disclosure. Therefore, the protection scope of the present disclosure should be subject to the protection scope of the claims.

What is claimed is:

1. A three-line four-way light string and control system thereof, characterized by comprising:

signal lines L1, L0, L2, wherein a plurality of LED lamps are connected between the signal line L1 and the signal line L0 in parallel;

a plurality of LED lamps are connected between the signal line L2 and the signal line L0 in parallel;

a program controller, wherein the program controller comprises an integrated chip U1, and a first pin, a third pin, a twelfth pin, a thirteenth pin and a fourteenth pin of the integrated chip U1 are floating;

a second pin of the integrated chip U1 is respectively connected to one end of a resistor R2 and a first pin of a relay J1, and the other end of the resistor R2 is respectively connected to one end of the capacitor C2, a fourth pin of the integrated chip U1, a third pin of the relay J1 and one end of a capacitor C1; the other end of the capacitor C2 is grounded; the fourth pin of the integrated chip U1 is connected to a power supply of 2.3-5.5 V; the other end of the capacitor C1 is connected to an eleventh pin of the integrated chip U1 and then is grounded; and a second pin of the relay J1 is grounded;

a fifth pin of the integrated chip U1 is connected to an input end Xin;

a sixth pin of the integrated chip U1 is connected to an output end Xout;

the input end Xin is respectively connected to one end of a capacitor C3 and one end of a crystal oscillator Y1; the other end of the capacitor C3 is grounded; and the other end of the crystal oscillator Y1 is connected to the output end Xout and then is grounded through the capacitor C4;

a seventh pin of the integrated chip U1 is grounded through a switch SW1;

an eighth pin of the integrated chip U1 is respectively connected to one end of a resistor R3, a grid electrode of a MOS transistor Q1 and a grid electrode of a MOS transistor Q2; the other end of the resistor R3 is grounded; a source electrode of the MOS transistor Q1 is grounded while a drain electrode thereof is connected to a drain electrode of the MOS transistor Q2 and then is connected to the signal line L2 together; and a source electrode of the MOS transistor Q2 is connected to the power supply of 2.3-5.5 V;

a ninth pin of the integrated chip U1 is respectively connected to one end of a resistor R4, a grid electrode of a MOS transistor Q3 and a grid electrode of a MOS transistor Q4; the other end of the resistor R4 is grounded; a source electrode of the MOS transistor Q3 is grounded while a drain electrode thereof is connected to a drain electrode of the MOS transistor Q4 and then is connected to the signal line L0 together; and a source electrode of the MOS transistor Q4 is connected to the power supply of 2.3-5.5 V; and a tenth pin of the integrated chip U1 is connected to one end of the resistor R2, and the other end of the resistor R2 is respectively connected to one end of a resistor R5, a grid electrode of a MOS transistor Q5 and a grid electrode of a MOS transistor Q6; the other end of the resistor R5 is grounded; a source electrode of the MOS transistor Q5 is grounded while a drain electrode thereof is connected to a drain electrode of the MOS transistor Q6 and then is connected to the signal line L1 together; and a source electrode of the MOS transistor Q6 is connected to the power supply of 2.3-5.5 V.

2. The three-line four-way light string and control system thereof according to claim 1, characterized in that a plurality of LED lamps are connected between the signal line L1 and the signal line L2 in parallel.

3. The three-line four-way light string and control system thereof according to claim 1, characterized by further comprising a signal line L0-1, wherein the signal line L0-1 is connected to the tail end of the signal line L0.

4. The three-line four-way light string and control system thereof according to claim 1, characterized in that the LED lamps are surface-mounted LED lamps.

5. The three-line four-way light string and control system thereof according to claim 1, characterized by further comprising a remote control matching with a program controller, wherein the remote control is internally provided with a chip and a storage battery, and the chip is provided with a wireless remote control device.

6. The three-line four-way light string and control system thereof according to claim 5, characterized in that the remote control is provided with a start key ON, a stop key OFF, a timing key TIMER, mode keys 1-8, a brightness reducing key – and a brightness increasing key +; and the start key ON, the stop key OFF, the timing key TIMER, the mode keys 1-8, the brightness reducing key – and the brightness increasing key + are connected to the chip.

7. The three-line four-way light string and control system thereof according to claim 1, characterized by further comprising a DC switched-mode power supply, wherein the DC switched-mode power supply is electrically connected to the program controller.

8. The three-line four-way light string and control system thereof according to claim 1, characterized in that the signal lines are copper lines.

9. The three-line four-way light string and control system thereof according to claim 1, characterized in that the LED lamps are arranged in a lampshade, and the lampshade has various colors.

* * * * *